US006261611B1

(12) United States Patent
Berman

(10) Patent No.: US 6,261,611 B1
(45) **Date of Patent: *Jul. 17, 2001**

(54) HAND-HELD FOOD PACKAGE AND METHOD OF USE

(75) Inventor: Robert E. Berman, East Norriton, PA (US)

(73) Assignee: Breakaway Foods, L.L.C., Blue Bell, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/940,570

(22) Filed: Sep. 30, 1997

Related U.S. Application Data

(60) Provisional application No. 60/030,773, filed on Nov. 13, 1996.

(51) Int. Cl.[7] ..... B65B 29/08; B65D 81/34

(52) U.S. Cl. ..... 426/90; 426/91; 426/107; 426/110; 426/113; 426/127; 426/115; 426/134; 426/234; 426/394; 426/407

(58) Field of Search ..... 426/110, 115, 426/113, 107, 91, 234, 134, 90, 394, 127, 407

(56) References Cited

U.S. PATENT DOCUMENTS

| | | | | |
|---|---|---|---|---|
| D. 388,236 | | 12/1997 | Goldstein . | |
| 1,555,705 | | 9/1925 | Roberts . | |
| 1,616,262 | | 2/1927 | Knaust . | |
| 1,933,596 | | 11/1933 | MacLean . | |
| 2,132,966 | | 10/1938 | O'Brien . | |
| 2,166,619 | * | 7/1939 | Becker | 426/115 |
| 2,270,935 | * | 1/1942 | Doering | 426/115 |
| 2,434,505 | | 1/1948 | Miller . | |
| 2,698,996 | | 1/1955 | Hickerson . | |
| 3,116,152 | | 12/1963 | Smith . | |
| 3,273,760 | | 9/1966 | Frankenberg . | |
| 3,342,609 | * | 9/1967 | Bank et al. | 426/110 |
| 3,417,862 | | 12/1968 | Fong . | |
| 3,432,027 | * | 3/1969 | Mueller | 426/115 |
| 3,595,449 | | 7/1971 | Stump et al. . | |
| 3,727,802 | | 4/1973 | Schnurmacher . | |
| 3,962,470 | | 6/1976 | Stucker . | |
| 4,144,356 | | 3/1979 | McDaniel . | |
| 4,350,712 | | 9/1982 | Kocharian et al. . | |
| 4,352,242 | | 10/1982 | Plet . | |
| 4,447,457 | | 5/1984 | Bernal . | |
| 4,795,652 | | 1/1989 | Cooper . | |
| 4,828,163 | * | 5/1989 | Yu | 426/115 |
| 4,938,975 | | 7/1990 | Waller . | |
| 4,966,781 | | 10/1990 | Artzer . | |
| 5,084,284 | * | 1/1992 | McDilda et al. | 426/115 |
| 5,111,973 | | 5/1992 | Mueller . | |
| 5,246,721 | | 9/1993 | Kerkonian . | |
| 5,348,751 | | 9/1994 | Packer et al. | 426/94 |
| 5,393,566 | | 2/1995 | Propst . | |
| 5,429,294 | | 7/1995 | Propst . | |
| 5,531,863 | | 7/1996 | Propst . | |
| 5,626,897 | | 5/1997 | Goldstein . | |

FOREIGN PATENT DOCUMENTS

| | | | | |
|---|---|---|---|---|
| 305326 | | 4/1918 | (DE) . | |
| 101833 | * | 5/1963 | (NO) | 426/115 |

OTHER PUBLICATIONS

Wiley Encyclopedia of Packaging Technology J. Wiley & Sons pp. 451–464, 497–506, 1986.*

Modern Packaging, p. 146, Nov. 1954.*

* cited by examiner

*Primary Examiner*—Steven Weinstein

(74) *Attorney, Agent, or Firm*—Caesar, Rivise, Bernstein, Cohen & Pokotilow, Ltd.

(57) ABSTRACT

A hand-held food package is provided which enables heterogeneous foods, such as filled pastas, burritos, and the like, to be shipped, stored and heated in the same disposable package from which they are extruded for direct consumption by the consumer without utensils.

67 Claims, 1 Drawing Sheet

FIG. 1
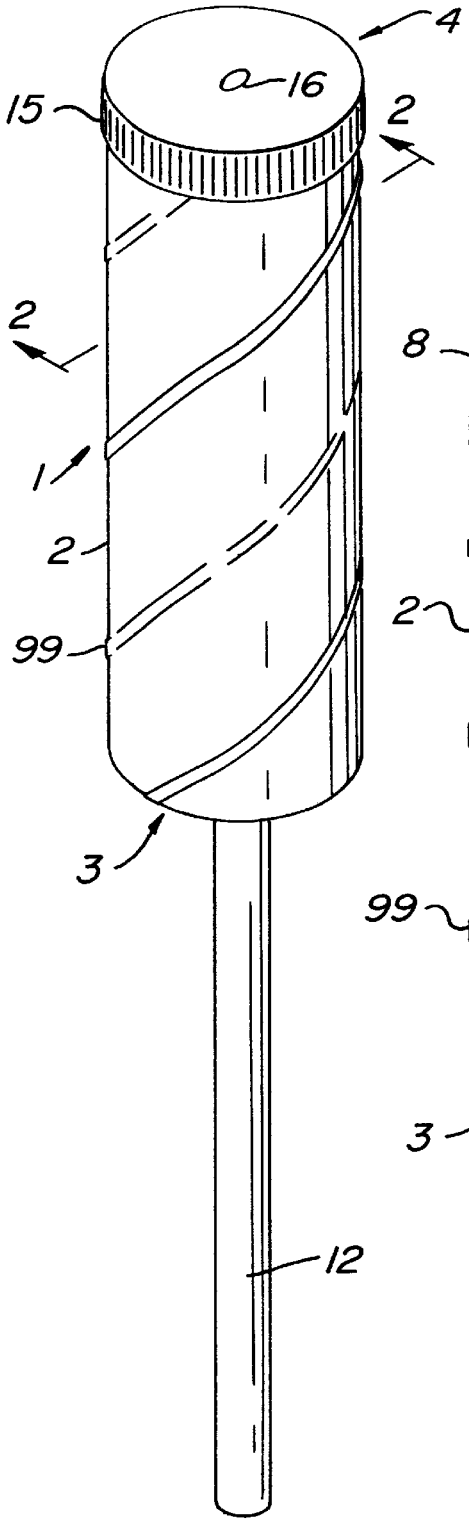
FIG. 2
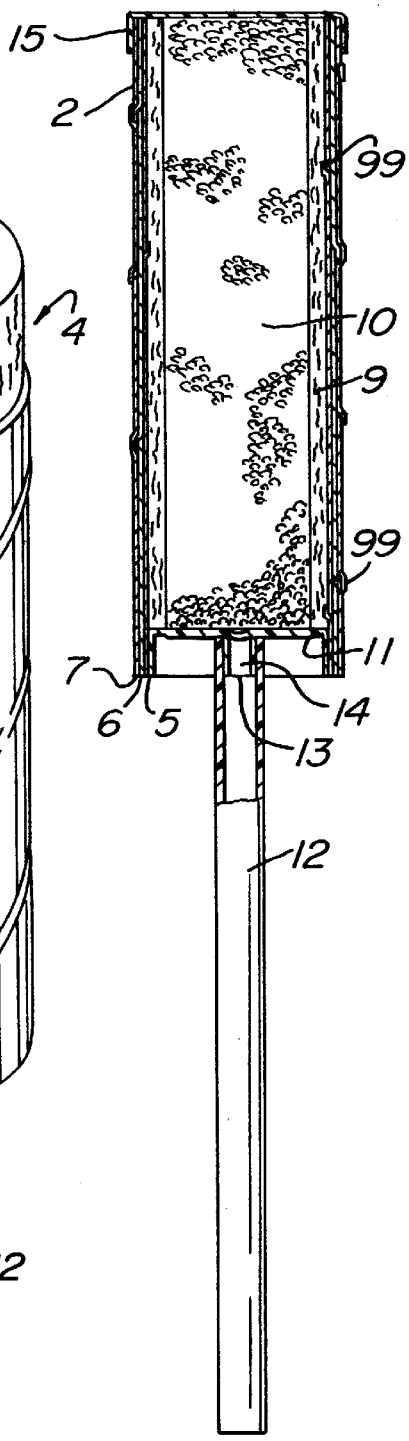
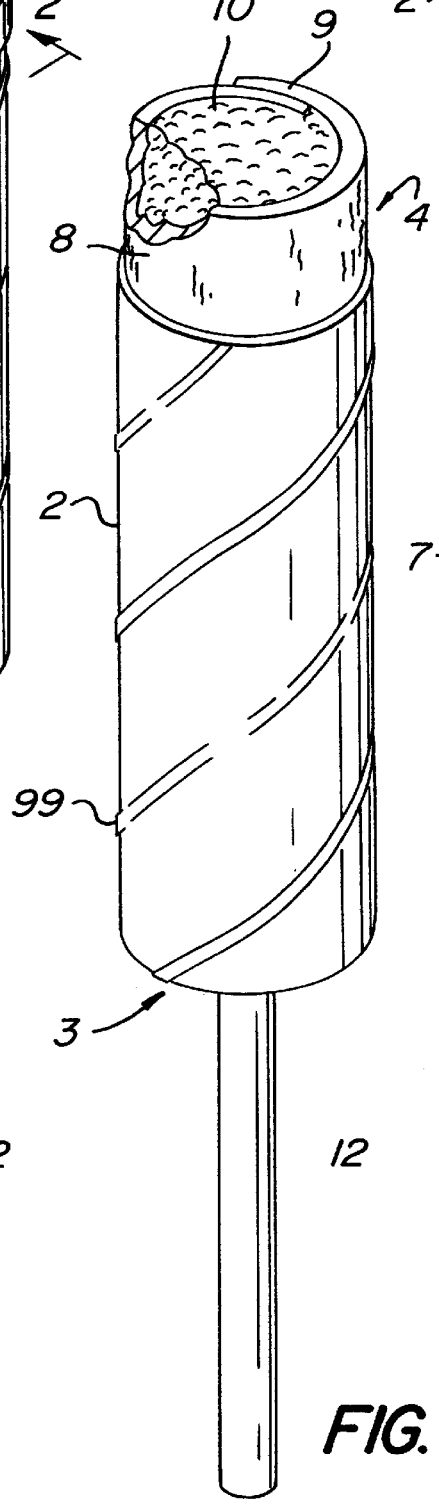
FIG. 3

HAND-HELD FOOD PACKAGE AND METHOD OF USE

CROSS-REFERENCE TO RELATED APPLICATIONS

This application claims priority from U.S. Provisional Patent Application No. 60/030,773, filed Nov. 13, 1996.

FIELD OF THE INVENTION

This invention relates to hand-held food packages, and more particularly, to a hand-held food package containing a single serving of food that is stored, optionally rethermalized, and served in the package, which is discarded after use.

BACKGROUND OF THE INVENTION

Americans have become a nation of grazers and snackers. Changes in family structure, including more working mothers, more single-parent households and more single-person households, mean less time to cook and, often, staggered meal times. Eating has evolved into an "anytime, anyplace" activity. Meals are often eaten on the run, and people tend to snack their way through the day. These changing eating patterns have produced a demand for "user-friendly" quick meals consumers can hold in their hands while walking, driving, or even shopping.

Although many social critics believe that the pace of civilization is ever increasing, such convenience foods and the need for them have been around a long time. For example, spectators at sporting events have been eating hot dogs on buns for many years, and a number of portable foods "on a stick" have been developed over the years, including corn dogs, ice cream, frozen fruit juice, frozen alcoholic beverages (see U.S. Pat. No. 4,350,712), friedcake (see U.S. Pat. No. 4,144,356), burritos (see U.S. Pat. No. 4,447,457) and pizza (see U.S. Pat. No. 4,966,781).

A product has been marketed for many years, which comprises ice cream in a tubular cardboard container with a piston underlying it. The ice cream is selectively advanced out of the tube by pushing a stick attached to the bottom of the piston. A similar confession holding device is described in U.S. Pat. No. 3,962,470.

Despite the advantages provided by such food products, there is still room for improvement with respect to a number of aspects.

Many foods on a stick have the stick penetrating the food as an anchor. It would be preferable to avoid this configuration, as the consumer can be injured by inadvertently biting the stick. Moreover, some of the food adheres to the stick during consumption, thus frustrating particularly hungry consumers.

Furthermore, the length of the stick outside of a food product mounted on or above a stick can raise packaging and transportation costs. The stick increases the effective volume occupied by the product. In addition, care must be taken to avoid damaging the stick, lest the food product be rendered stickless, and thus unmerchantable.

Moreover, portable foods in general, and foods mounted on or above a stick in particular, have not been particularly conducive to a healthy lifestyle. While it might be preferable from a health perspective to sit down to a balanced meal served on a plate, convenience foods need not be nutritionally inferior to conventional foods. Until now, however, most portable foods, including foods mounted on or above a stick, such as cotton candy, lollipops, candy apples, ice cream pops and the like, have been designed as special treats rather than diet staples. Thus, there has been a need for more healthful portable food products, including those mounted on or above a stick.

Foods mounted on or above a stick have mostly been confined to solids for obvious reasons. It would be preferable if foods having significant liquid components, such as sauces, dressings, melted cheese, syrup and/or fruit compotes, could be successfully mounted and served mounted on or above a stick, as well.

Thus, foods such as pasta, pancakes, omelettes, crepes, wantons and blintzes have not been provided on or above a stick in a hand-held food package.

All references cited herein are incorporated herein by reference in their entireties.

SUMMARY OF THE INVENTION

The invention addresses at least the foregoing deficiencies in the art by providing a hand-held food package comprising:

- a tubular container which is ovenable and comprises a piston receiving end and a food extruding end;
- a food tube contained within said tubular container between said piston receiving end and said food extruding end, said food tube comprising a rolled sheet of food;
- an ovenable piston slidably engaged within said tubular container at said piston receiving end below said food tube, wherein said piston is adapted to slide through said container toward said food extruding end to selectively extrude said food tube from said food extruding end of said container; and
- a removable cover which seals at least the food extruding end of said container.

The invention further provides a method for providing the aforementioned food product, said method comprising:

- providing an ovenable tubular container;
- providing a wrappable sheet of food;
- wrapping said sheet of food to form a food tube;
- inserting said food tube into said tubular container;
- slidably engaging an ovenable piston within a bottom portion of said tubular container; and
- removably sealing said food tube within said tubular container,
- wherein said food tube is above said piston within said tubular container.

BRIEF DESCRIPTION OF THE DRAWINGS

The invention will be described in conjunction with the following drawings in which like reference numerals designate like elements and wherein:

FIG. 1 is a perspective view of a preferred embodiment of the food package of the invention;

FIG. 2 is a cross-sectional view through line 2—2 of FIG. 1; and FIG. 3 is a perspective view of the embodiment of FIGS. 1 and 2 after partial consumption by a consumer.

DETAILED DESCRIPTION OF PREFERRED EMBODIMENTS

A hand-held food package according to the invention enables the consumer the opportunity to enjoy foods, such as pasta, while driving, sitting in a ballpark, walking, or being engaged in almost any activity, because no utensils are required. The pasta is delivered through a convenient, ovenable, hand-held, easy to use and disposable container designed specifically and uniquely for this use.

Referring to the figures, the package 1 includes a tubular container 2 having a piston receiving end 3 and a food extruding end 4. Container 2 is preferably ovenable, and more preferably, microwaveable. That is, the constitution of container 2 allows its contents to be heated in the container placed in an oven (most preferably a microwave oven) without significantly damaging container 2.

Container 2 is preferably cylindrical, and formed from materials in which food products can be stored and heated. Suitable materials for container 2 include, for example, paper, cardboard, plastic, coated paper products, such as Spectragard™ (an acrylic resin coated paper, which acts as a moisture barrier against water and oils, is prepared by the process disclosed in U.S. Pat. Nos. 5,531,863; 5,429,294; and 5,393,566, and is available from Spectra-Kote Corp., Gettysburg, Pa., USA), and certain edible materials, such as bread.

FIG. 2 depicts container 2 with three helically wound layers: an innermost layer 5, an intermediate layer 6 and an outermost layer 7. It should be understood that the figures are not drawn to scale and that the invention is not limited to the absolute or relative dimensions depicted therein. Thus, layers 5, 6 and 7 are enlarged in FIG. 2 for ease of viewing relative to their normal scale.

It is preferred that one of innermost layer 5 and intermediate layer 6 be a moisture barrier, such as Spectragard™, and it is particularly preferred that innermost layer 5 be the moisture barrier. Layers 5, 6 and 7 can be of the same thickness (as shown) or dissimilar thicknesses. The layers are preferably bonded along seams 99 to each other with edible glue (not shown). Suitable glues include, e.g., water-based glues, such as XR-6111 available from H. B. Fuller Co., Vadnais Heights, Minn., USA.

The cylinder is preferably manufactured at a specific thickness gauge to allow for heating in a microwave oven and then, once cooked, for the heat to dissipate in order to cool the product for consumption (however, much of the heat dissipates through the food extruding end 4 of container 2, particularly after food package 1 is no longer sealed). The interior of the cylinder is developed in such a manner as to inhibit the transfer of moisture from the inside of the product to the outside of the container, to avoid soiling the hands of the consumer. A moisture barrier as the innermost layer 5, facilitates maintaining the structure of container 2 during heating, preventing the outermost layer 7 from softening, containing steam within container 2 during heating, sliding the contents of container 2 through container 2 (since the moisture barrier typically has a slicker finish than uncoated paper) and preventing the user's hands from being soiled.

In a particularly preferred embodiment, innermost layer 5 is a 42 lb. bleached sheet of Spectragard™, intermediate layer 6 is a 42 lb. bleached kraft paper, and outermost layer 7 is a 35 lb. paper coated on one side and printed with an overprint varnish.

Microwaveable containers according to the invention provide an improved method for microwaving materials in general. These containers enable more uniform heating of the contents, while at the same time, preventing an undesirable amount of moisture from escaping from the contents.

Container 2 contains a food tube 8 between piston receiving end 3 and food extruding end 4. In certain embodiments, food tube 8 comprises a rolled sheet of food 9 enclosing filler food 10. In other embodiments, food tube 8 simply consists of at least one rolled sheet of food 9.

The sheet of food 9 can be any food product sufficiently flexible to be rolled into the form of a cylinder, and is preferably selected from the group consisting of a sheet of pasta, a tortilla, a crepe, a pancake, an omelette, a sheet of phyllo dough, an edible leaf (e.g., a cabbage leaf), a sheet of meat (e.g., a thinly-sliced sheet or pounded sheet of beef, fish or poultry) and fruit wraps. Sheet of food 9 can be rolled in a variety of ways to form food tube 8. Opposite edges of a rectangular sheet of food 9 can be overlapped with one another to form tube 8, as is commonly done to form cannelloni. Alternatively, sheet of food 9 can be rolled-up or wound about itself starting from an one edge of the sheet until the opposite edge of the sheet is reached, as is commonly done to form cinnamon pastries. For example, a pancake can be wound about itself to form food tube 8, with or without a filler food 10, such as syrup and/or apple slices. The density of food tube 8 can be increased by rolling up a plurality of layered food sheets 9. Thus, two rectangular pancakes can be stacked and rolled to form a dense food tube 8 for insertion into container 2.

Filler food 10 preferably differs from sheet of food 9, and can be, e.g., a food which would otherwise be hard to consume neatly without utensils, such as ricotta cheese, scrambled eggs, shredded meat, melted cheese, sauce, and pasta (e.g., manicotti or elbow macaroni).

Filler food 10 is preferably a food that is non-self-supporting at its serving temperature. A food is not self-supporting for present purposes if it cannot be formed into a stable column that can be moved without bending or collapsing and without the use of binding or containment means. Serving temperature is defined as the temperature of the food as it is being consumed, not the ambient temperature of the environment in which the food is being consumed. Some examples of foods that are not self-supporting at their serving temperatures include spaghetti and pasta salad. An example of a food that is self-supporting at its serving temperature is ice cream.

Some particularly preferred combinations of sheet of food 9 and filler food 10 are a sheet of pasta filled with a filler comprising cheese, meat and/or tomato sauce; a tortilla filled with a filler comprising meat, cheese and/or beans; an omelette filled with cheese and/or meat; and a tortilla, a crepe, or a sheet of phyllo dough filled with discrete portions of cooked egg. In certain embodiments, food tube 8 is not self-supporting at its serving temperature.

In certain embodiments, container 2 is filled with an unwrapped food that is not self-supporting at its serving temperature. For example, container 2 can be filled with tuna salad, chicken salad, etc., without being enveloped by a sheet of food.

Prior to serving the food, an ovenable piston 11 is slidably engaged within tubular container 2 at piston receiving end 3 below food tube 8. Piston 11 is adapted to slide through container 2 toward food extruding end 4 to selectively extrude food tube 8 from food extruding end 4 of container 2. Piston 11 is elevated through container 2 under force applied by the consumer.

As shown in the figures, a stick 12 is preferably used to urge piston 11 through container 2. Stick 12 is attached (preferably removably) to piston 11 via a socket 13 on an end of stick 12 which engages a plug 14 on the underside of piston 11. Of course, stick 12 and piston 11 can be joined in a variety of other ways, including, but not limited to: inserting an end of stick 12 into a socket on the bottom of piston 11 (not shown); molding piston 11 and stick 12 as a unitary piece (not shown); and gluing piston 11 and stick 12 together (not shown).

Piston 11 and stick 12 can be made from the same or different materials. If stick 12 is not permanently attached to piston 11, then it need not be ovenable, since it can be separated from the balance of package 1 during heating. Stick 12 can comprise, e.g., plastic, such as high impact styrene, or wood, such as white birch wood. Stick 12 is preferably about as long as container 2, so that food tube 8 can be completely extruded though food extruding end 4 without requiring the consumer's hand to enter the piston receiving end 3 of container 2, where it might be soiled. The thickness and shape of stick 12 are not particularly limited, except that the dimensions must be selected so that stick 12 is strong enough to advance food tube 8 through container 2 without breaking and/or substantially bending. The dimensions of stick 12 should also be ergonomically correct.

In a preferred embodiment, stick 12 is a cylindrical tube of high impact styrene having an inside diameter of 0.247 inches (0.63 cm), an outside diameter of 0.320 inches (0.82 cm), and a length of 5.375 inches (13.78 cm). In another preferred embodiment, stick 12 is a cylindrical piece of white birch wood with a chamfered end for insertion into a socket in the piston, wherein the stick has a diameter of 0.17 inches (0.44 cm) and a length of 5.35 inches (13.71 cm).

Piston 11 and container 2 can be made from the same or different materials. Piston 11 is preferably plastic, most preferably injection molded polyethylene. Piston 11 is preferably ovenable, more preferably microwaveable. The shape of piston 11 is not particularly limited, except that its external circumference should conform to the internal circumference of container 2. Thus, piston 11 is preferably circular so as to conform with the most preferred cylindrical shape of container 2. Piston 11 should fit snugly within container 2, so as to prevent liquids from seeping out of container 2, and yet, should not be so snug as to hinder sliding piston 11 through container 2.

In a preferred embodiment, piston 11 is circular with an outside diameter of 1.604 inches (4.11 cm), and plug 14 has an inside diameter sloping from 0.177 inches (0.45 cm) at its stick end down to 0.160 (0.41 cm) inches at its piston end.

The shape of container 2 is not limited to a cylinder. Other suitable shapes have cross-sections that are, e.g., oblong, square, rectangular, triangular, polygonal and irregular. The length and width of container 2 is dictated by ergonomics, since it is designed to be held in one hand while the other hand manipulates stick 12, and by the desired quantity of food to be dispensed. The dimensions can be adjusted to allow for the desired fill weight of food. For example, a suitable cylinder can have an inside diameter of 1.575 inches (4.04 cm), an outside diameter of 1.625 inches (4.17 cm) and a length of 5.375 inches (13.78 cm).

Package 1 includes a removable cover or cap 15 which seals at least the food extruding end 4 of container 2. The removable seal can be, e.g., a plastic bag which surrounds the entire container 2, a plug which is removably inserted in the food extruding end 4 of container 2 or, as shown in FIGS. 1 and 2, a paper cap which is removably glued over the food extruding end 4 of container 2. The glue should be edible and should preferably soften at cooking temperature so that the paper cap can be easily removed after heating and prior to consumption. Suitable glues include, e.g., water-based glues, such as XR-6111.

Cap 15 preferably includes a mark or weakened area 16 for puncturing in order to allow steam to escape from container 2 during cooking/heating. Alternatively, food package 1 can include instructions to the consumer to puncture cap 15 at an unspecified or predetermined location.

In order to facilitate insertion of food tube 8 into, and extrusion of food tube 8 out of, container 2, it is preferred to have an edible lubricant (not shown) coated on an interior surface of container 2 and/or an external surface of food tube 8. The edible lubricant is preferably a sauce (e.g., tomato sauce or barbecue sauce), gravy, syrup, dressing (e.g., mustard or ketchup), cheese, mayonnaise, oil (e.g., PAM™) and/or fat (e.g., lard) also contained within food tube 8. It is preferred to use a tomato sauce as a lubricant when sheet of food 9 is pasta.

FIG. 3 shows package 1 with cap 15 removed and food tube 8 partially extruded from container 2. A portion of food tube 8 has been consumed, thus revealing details of its remaining structure, including sheet of food 9 and filler food 10.

The container 2, piston 11 and stick 12 of the invention can be produced by adaption of conventional means known in the art. For example, a pasta product can be produced by precooking pasta, cutting the pasta into a sheet form conforming with the dimensions of the desired container, placing a filler on the sheet and then rolling the sheet into the appropriate circumference. Once formed, the pasta tube is flash frozen to preserve quality and allow for future consumption, and inserted into the container. Additional condiments, such as cheese and/or sauce toppings can then be added above the food tube in the container. The container is then sealed and frozen for shipping and storage. Although it is preferred to freeze the pasta tube prior to insertion into the container, the pasta tube and container can simply be frozen or refrigerated after assembly.

It is preferred to fully cook sheet of food 9 and to at least partially cook filler food 10 prior to assembling food tube 8 and inserting it into container 2. If any portion of the food package 1 is uncooked, cooking can be completed within container 2 just prior to serving. Otherwise, if food tube 8 is to be served at a temperature above its storage temperature, it can be thawed and/or heated within container 2 to its serving temperature. The optimum rethermalizing method is dictated by the nature of food tube 8. In the case of a pasta food tube, the best results are obtained by thawing the frozen package in a refrigerator, and then heating the package in a microwave oven for about 1 minute on high.

Cooking (and/or sterilization) can be complete prior to inserting food tube 8 into container 2. Food tube 8 can subsequently be reheated in container 2, if desired, and consumed. Cooking, sterilization and/or heating can be accomplished by any suitable means, such as convective or conductive heating, and more preferably microwave irradiation.

The invention enables a food product in the form of a food tube to be shipped, stored, optionally defrosted and optionally heated in the same container from which the food product is extruded for direct consumption by the consumer without utensils, wherein the container is disposable after use.

While the invention has been described in detail and with reference to specific examples thereof, it will be apparent to one skilled in the art that various changes and modifications can be made therein without departing from the spirit and scope thereof.

What is claimed is:

1. A hand-held food package comprising:

a microwaveable elongated container comprising a piston receiving end and a food extruding end at opposite ends of a longitudinal axis defined by said elongated container, and a peripheral wall running from said piston receiving end to said food extruding end, wherein said food extruding end has an unobstructed opening defined by a plane perpendicular to said longitudinal axis;

a food mass, which is to be heated by microwave energy to a serving temperature for consumption, contained within said elongated container between said piston receiving end and said food extruding end, said food mass comprising at least one rolled sheet of food containing ingredients that are normally non-self-supporting at said serving temperature;

a microwaveable piston slidably engaged within said elongated container at said piston receiving end below said food mass, wherein said piston is adapted to slide through said container toward said food extruding end to selectively extrude said food mass beyond said extruding end of said container, while maintaining a snug fit with said container so that no leakage of said food ingredients occurs; and a removable cover which seals at least the food extruding end of said container, wherein said peripheral wall comprises at least three overlapping paper layers, including an innermost layer, at least one intermediate layer and an outermost layer, and wherein at least one of said innermost layer and said at least one intermediate layer is a moisture barrier layer, such that said peripheral wall: (a) maintains the structure of said container rigid during freezing and heating; (b) inhibits seepage of steam therethrough during heating; (c) prevents seepage of said ingredients therethrough; and (d) dissipates heat at a rate substantially lower than said food extruding end of said container so as to provide improved uniform heating by microwave energy.

2. The hand-held food package of claim 1, further comprising a stick mounted under said piston for sliding said piston within said elongated container.

3. The hand-held food package of claim 2, wherein said elongated container is symmetrical for its entire length about a central longitudinal axis partially defined by said stick.

4. The hand-held food package of claim 1, wherein said moisture barrier layer further comprises a polymer that resists penetration by water and oil.

5. The hand-held food package of claim 4, wherein said moisture barrier layer comprises paper treated with water and oil resistant agents.

6. The hand-held food package of claim 4, wherein said elongated container further comprises edible glue.

7. The hand-held food package of claim 1, wherein said rolled sheet of food is selected from the group consisting of a sheet of pasta, a tortilla, a crêpe, a pancake, an omelette, a sheet of phyllo dough, an edible leaf, a sheet of meat and fruit wraps.

8. The hand-held food package of claim 7, wherein said rolled sheet of food is wrapped around a filler food differing from said rolled sheet of food.

9. The hand-held food package of claim 8, wherein said rolled sheet of food is a rolled sheet of pasta and said filler food comprises at least one member selected from the group consisting of meat, cheese and tomato sauce.

10. The hand-held food package of claim 8, wherein said rolled sheet of food is a tortilla and said filler food comprises at least one member selected from the group consisting of meat, cheese and beans.

11. The hand-held food package of claim 8, wherein said filler food comprises discrete portions of cooked egg.

12. The hand-held food package of claim 1, wherein said rolled sheet of food is wrapped around a filler food differing from said rolled sheet of food.

13. The hand-held food package of claim 1, wherein said rolled sheet of food is wound about itself.

14. The hand-held food package of claim 1, wherein an edible lubricant is coated on at least one of an interior surface of said elongated container and an exterior surface of said food mass.

15. The hand-held food package of claim 14, wherein said edible lubricant is at least one member selected from the group consisting of sauce, gravy, syrup, dressing, cheese, mayonnaise, oil and fat.

16. The hand-held food package of claim 14, wherein said edible lubricant is tomato sauce, cheese, mayonnaise, mustard, ketchup or barbecue sauce.

17. The hand-held food package of claim 1, wherein said food mass comprises a plurality of rolled food sheets.

18. A method of making a food package, said method comprising:

providing said elongated container of claim 1;

providing at least one wrappable sheet of food;

wrapping said sheet of food to form said food mass of claim 1;

inserting said food mass into said elongated container;

providing said ovenable piston of claim 1 slidably engaged within a bottom portion of said elongated container; and removably sealing said food mass within said elongated container.

19. The method of claim 18, wherein a filler food is provided on said sheet of food before said wrapping, and said filler food is wrapped within said sheet of food.

20. The method of claim 19, wherein said sheet of food and said filler food are partially cooked prior to insertion into said elongated container, and cooking is completed within said elongated container.

21. The method of claim 18, wherein said sheet of food and said filler food are cooked and frozen prior to insertion into said elongated container, and are heated to serving temperature prior to being consumed.

22. The method of claim 21, wherein said heating is at least partially accomplished by irradiating said elongated container with microwave radiation.

23. The method of claim 21, wherein said heating is at least partially accomplished by radiant or convective heat.

24. The method of claim 18, wherein said food mass is shipped, stored and heated in said elongated container, and extruded from said elongated container for consumption without utensils.

25. The method of claim 18, wherein an edible lubricant is applied to at least one of an internal surface of said elongated container and an external surface of said food mass, prior to inserting said food mass into said elongated container.

26. The method of claim 18, wherein said sheet of food is selected from the group consisting of a sheet of a sheet of pasta, a tortilla, a crêpe, a pancake, an omelette, a sheet of phyllo dough, an edible leaf, a sheet of meat and fruit wraps.

27. The method of claim 18, wherein said food mass is formed from a plurality of wrappable food sheets.

28. The hand-held food package of claim 1, wherein said elongated container has a constant transverse cross-section throughout its entire length.

29. The hand-held food package of claim 1, wherein said elongated container is a right circular cylinder.

30. The hand-held food package of claim 1, wherein said food extruding end of said elongated container lies completely within a plane perpendicular to said longitudinal axis of said elongated container.

31. The hand-held food package of claim 1, wherein said elongated container has a length to inside diameter ratio of about 3.4.

32. A hand-held food package comprising:

a microwaveable elongated container comprising a piston receiving end and a food extruding end at opposite ends of a longitudinal axis defined by said elongated container, and a peripheral wall running from said piston receiving end to said food extruding end, wherein said food extruding end has an unobstructed opening defined by a plane perpendicular to said longitudinal axis;

a food mass, which is to be heated by microwave energy to a serving temperature for consumption, contained within said elongated container between said piston receiving end and said food extruding end, wherein said food mass is normally not self-supporting at said serving temperature;

a microwaveable piston slidably engaged within said elongated container at said piston receiving end below said food mass, wherein said piston is adapted to slide through said container toward said food extruding end to selectively extrude said food mass beyond said food extruding end of said container, while maintaining a snug fit with said container so that no leakage of ingredients of said food mass occurs; and a removable cover which seals at least the food extruding end of said container, wherein said peripheral wall comprises at least three overlapping paper layers, including an innermost layer, at least one intermediate layer and an outermost layer, and wherein at least one of said innermost layer and said at least one intermediate layer is a moisture barrier layer, such that said peripheral wall: (a) maintains the structure of said container rigid during freezing and heating; (b) inhibits seepage of steam therethrough during heating; (c) prevents seepage of said ingredients therethrough; and (d) dissipates heat at a rate substantially lower than said food extruding end of said container so as to provide improved uniform heating by microwave energy.

33. The hand-held food package of claim 32, wherein said food mass lacks a rolled sheet of food as a wrap.

34. An improved method for consuming a non-self supporting food, said method comprising:

providing said hand-held food package of claim 32;

sliding said piston through said elongated container toward said food extruding end to selectively extrude said food mass from said food extruding end of said elongated container;

inserting into a mouth of a consumer an inserted portion of said hand-held food package consisting essentially of a majority of said food mass; and biting through said inserted portion to sever it from a balance of said food mass to consume said non-self supporting food.

35. The improved method of claim 34, further comprising heating said hand-held food package without substantially damaging said elongated container.

36. The improved method of claim 35, wherein said hand-held food package is heated to cook, warm or thaw said food mass prior to said food mass extrusion.

37. The improved method of claim 35, wherein said hand-held food package is heated by microwave radiation.

38. The hand-held food package of claim 32, further comprising a stick mounted under said piston for sliding said piston within said elongated container.

39. The hand-held food package of claim 38, wherein said elongated container is symmetrical for its entire length about a central longitudinal axis partially defined by said stick.

40. The hand-held food package of claim 32, wherein said moisture barrier layer further comprises a polymer that resists penetration by water and oil.

41. The hand-held food package of claim 32, wherein said moisture barrier layer comprises paper treated with water and oil resistant agents.

42. The hand-held food package of claim 32, wherein said elongated container further comprises edible glue.

43. The hand-held food package of claim 32, wherein said food mass is a rolled sheet of food selected from the group consisting of a sheet of pasta, a tortilla, a crêpe, a pancake, an omelette, a sheet of phyllo dough, an edible leaf, a sheet of meat and fruit wraps.

44. The hand-held food package of claim 43, wherein said rolled sheet of food is wrapped around a filler food differing from said rolled sheet of food.

45. The hand-held food package of claim 44, wherein said rolled sheet of food is a rolled sheet of pasta and said filler food comprises at least one member selected from the group consisting of meat, cheese and tomato sauce.

46. The hand-held food package of claim 44, wherein said rolled sheet of food is a tortilla and said filler food comprises at least one member selected from the group consisting of meat, cheese and beans.

47. The hand-held food package of claim 44, wherein said filler food comprises discrete portions of cooked egg.

48. The hand-held food package of claim 32, wherein said food mass is a sheet of food wound about itself.

49. The hand-held food package of claim 48, wherein said sheet of food is selected from the group consisting of a sheet of pasta, a tortilla, a crêpe, a pancake, an omelette, a sheet of phyllo dough, an edible leaf, a sheet of meat and fruit wraps.

50. The hand-held food package of claim 32, wherein an edible lubricant is coated on at least one of an interior surface of said elongated container and an exterior surface of said food mass.

51. The hand-held food package of claim 50, wherein said edible lubricant is at least one member selected from the group consisting of sauce, gravy, syrup, dressing, cheese, mayonnaise, oil and fat.

52. The hand-held food package of claim 50, wherein said edible lubricant is tomato sauce, cheese, mayonnaise, mustard, ketchup or barbecue sauce.

53. The hand-held food package of claim 32, wherein said food mass comprises a plurality of rolled food sheets.

54. The hand-held food package of claim 32, wherein said elongated container has a constant transverse cross-section throughout its entire length.

55. The hand-held food package of claim 32, wherein said elongated container is a right circular cylinder.

56. The hand-held food package of claim 32, wherein said food extruding end of said elongated container lies completely within a plane perpendicular to said longitudinal axis of said elongated container.

57. The hand-held food package of claim 32, wherein said elongated container has a length to inside diameter ratio of about 3.4.

58. A hand-held food package comprising:

a microwaveable elongated container comprising a piston receiving end and a food extruding end at opposite ends of a longitudinal axis defined by said elongated container, and a peripheral wall running from said piston receiving end to said food extruding end, wherein said food extruding end has an unobstructed opening defined by a plane perpendicular to said longitudinal axis;

a food mass, which is to be heated by microwave energy to a serving temperature for consumption, contained within said elongated container between said piston receiving end and said food extruding end, wherein said food mass comprises a filler food in an edible cover and is self-supporting at said serving temperature; and a microwaveable piston slidably engaged within said elongated container at said piston receiving end below said food mass, wherein said piston is adapted to slide through said container toward said food extruding end to selectively extrude said food mass beyond said food extruding end of said container, while maintaining a snug fit with said container so that no leakage of ingredients of said food mass occurs, wherein said peripheral wall comprises at least three overlapping paper layers, including an innermost layer, at least one intermediate layer and an outermost layer, and wherein at least one of said innermost layer and said at least one intermediate layer is a moisture barrier layer, such that said peripheral wall: (a) maintains the structure of said container rigid during freezing and heating; (b) inhibits seepage of steam therethrough during heating; (c) prevents seepage of said ingredients therethrough; and (d) dissipates heat at a rate substantially lower than said food extruding end of said container so as to provide improved uniform heating by microwave energy.

59. The hand-held food package of claim 58, further comprising a stick mounted under said piston for sliding said piston within said elongated container.

60. The hand-held food package of claim 58, wherein said moisture barrier layer further comprises a polymer that resists penetration by water and oil.

61. The hand-held food package of claim 60, wherein said moisture barrier comprises paper treated with water and oil resistant agents.

62. The hand-held food package of claim 61, wherein said elongated container further comprises edible glue.

63. The hand-held food package of claim 58, wherein said edible cover is selected from the group consisting of a sheet of pasta, a tortilla, a crêpe, a pancake, an omelette, a sheet of phyllo dough, an edible leaf, a sheet of meat and fruit wraps.

64. The hand-held food package of claim 63, wherein said edible cover is pasta and said filler food comprises at least one member selected from the group consisting of meat, cheese and tomato sauce.

65. The hand-held food package of claim 63, wherein said edible cover is a tortilla and said filler food comprises at least one member selected from the group consisting of meat, cheese and beans.

66. The hand-held food package of claim 58, wherein an edible lubricant is coated on at least one of an interior surface of said elongated container and an exterior surface of said food mass.

67. The hand-held food package of claim 58, further comprising a removable cover which seals at least said food extruding end of said container.

* * * * *